US005716331A

United States Patent [19]

Chang

[11] Patent Number: 5,716,331

[45] Date of Patent: Feb. 10, 1998

[54] MASSAGE DEVICE HAVING A MOTOR FOR VIBRATING AND RECIPROCATING A MASSAGE PAD WITH PROTRUSIONS

[76] Inventor: Li-hsia Chang, No. 16-1, Lane 742, Sanfeng Rd., Fengyuan City, Haichung Hsien, Taiwan

[21] Appl. No.: 792,762

[22] Filed: Feb. 4, 1997

[51] Int. Cl.[6] ..... A61H 1/00

[52] U.S. Cl. ..... 601/50; 601/70; 601/28; 601/66; 601/86; 601/87

[58] Field of Search ..... 601/22, 28, 49–51, 601/53, 66, 70, 86, 87, 89–93, 95, 97, 98, 101, 103, 104

[56] References Cited

U.S. PATENT DOCUMENTS

| | | | |
|---|---|---|---|
| 1,970,233 | 8/1934 | Hertzberg | 601/90 |
| 2,271,382 | 1/1942 | Worthington | 601/66 X |
| 3,140,711 | 7/1964 | McGathey | 601/70 X |
| 3,322,117 | 5/1967 | McCaw | 601/87 X |
| 3,581,739 | 6/1971 | Brandt | 601/49 X |

FOREIGN PATENT DOCUMENTS

| | | | |
|---|---|---|---|
| 2713438 | 9/1978 | Germany | 601/86 |
| 405285190 | 11/1993 | Japan | 601/22 |

*Primary Examiner*—Danton D. DeMille

*Attorney, Agent, or Firm*—Kolisch, Hartwell, Dickinson, McCormack & Heuser

[57] ABSTRACT

A massage device includes a base in which a motor case is fixedly disposed and a motor with an eccentric rod is received in the motor case, the motor case having at least three feet extending therefrom so as to be fixedly disposed in the base. A cap is mounted to the motor case and the eccentric rod extends through the cap. A massage pad has a recess defined in an under surface thereof for the eccentric rod to be received therein. A cushion device is disposed between the cap and the massage pad.

8 Claims, 6 Drawing Sheets

MASSAGE DEVICE HAVING A MOTOR FOR VIBRATING AND RECIPROCATING A MASSAGE PAD WITH PROTRUSIONS

BACKGROUND OF THE INVENTION

1. Field of the Invention

The present invention relates to a massage device and more particularly, to a massage device having a motor case with at least three feet extending therefrom a motor disposed in the motor case and a massage pad driven by the motor with a cushion means disposed between the motor case and the massage pad.

2. Brief Description of the Prior Art

Massage devices are used to mitigate tensioned muscles of a user so as to let the user feel at ease physically. Most of the massage devices are driven by a motor which is received in a case which requires a plurality of plates so that the motor is supported and fixed thereto. In other words, the motor generally has a tubular casing such that when the motor is to be fixedly disposed in a case of the massage device, there must has some plates extending from the case so as to fix a position of the motor. Complicated molds are required to manufacture such a case and is difficult to fix the motor in the case as the plates are usually located within the case.

The present invention intends to provide a massage device having a motor case with at least three feet, a massage pad driven by a motor in the motor case and a cushion means disposed between the motor case and the massage pad wherein the motor case is easily positioned and assembled to a base of the massage device so as to mitigate and/or obviate the above-mentioned problems.

SUMMARY OF THE INVENTION

The present invention provides a massage device which includes a base having a first hole defined in a top plate thereof and a motor case disposed in the base.

The motor case has a motor disposed therein which has a shaft extending through the first hole of the base and a second hole defined in the motor case. The shaft has an eccentric rod extending therefrom. At least three feet extend downwardly from the motor case so as to be fixedly disposed in the base. A weight has a hole eccentrically defined therein so as to be mounted to the eccentric rod.

A cap is mounted to the second peripheral wall of the motor case and has a third hole defined therein such that the eccentric rod of the shaft extends through the third hole. At least three ribs extend laterally from the cap and each of the ribs has a block formed thereto.

A massage pad has a plurality of first massage protrusions extending from an upper surface thereof and a recess defined in an under surface thereof such that the eccentric rod is rotatably received in the recess. The massage pad is fixedly connected to the blocks with a cushion means disposed between the massage pad and the blocks.

It is an object of the present invention to provide a massage device having a motor case with at least three feet to be fixedly disposed to a bottom plate of a base.

It is another object of the present invention to provide a massage device having a cushion means disposed between the massage pad and the cap mounted on the motor case.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
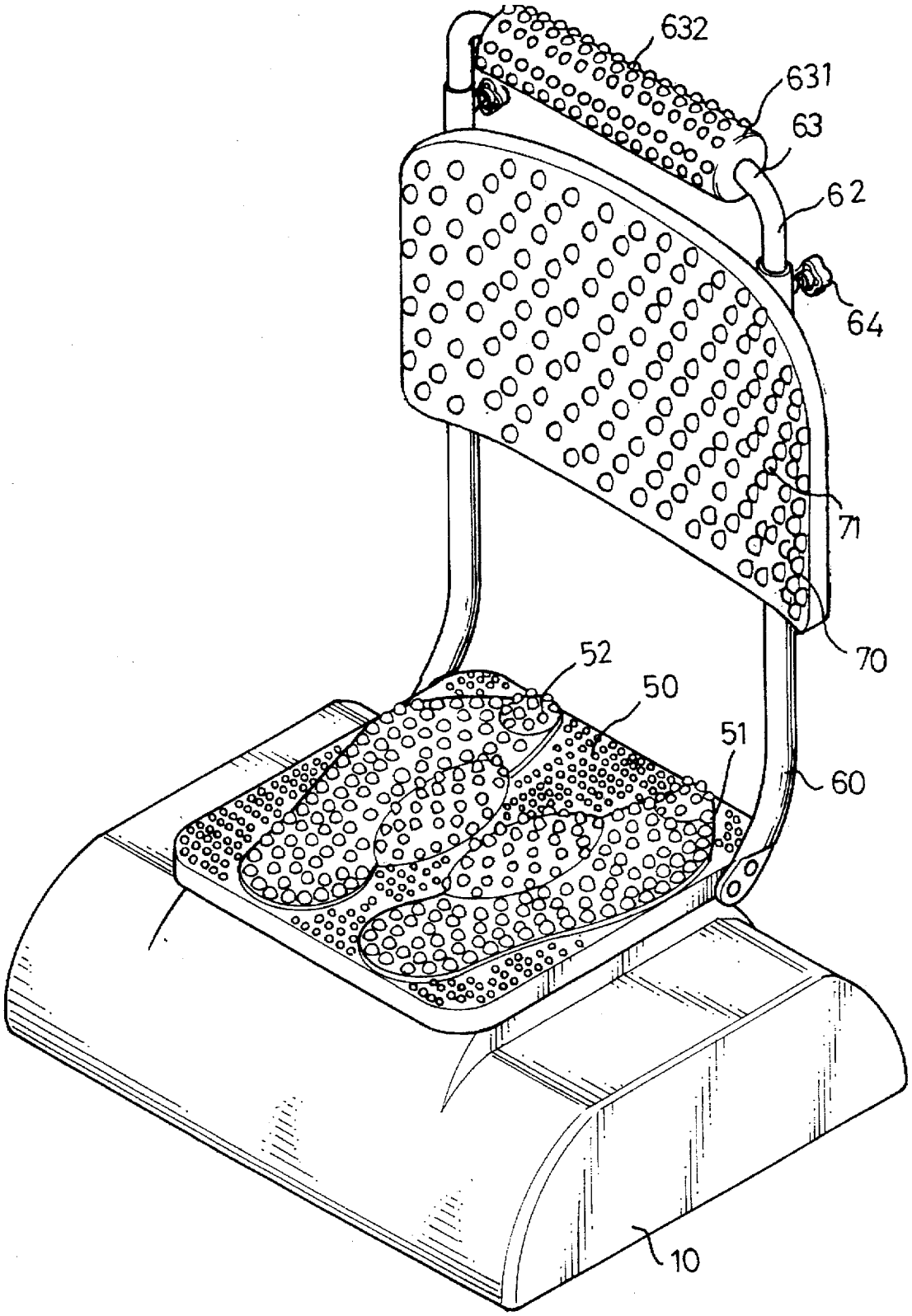
FIG. 1 is a perspective view of a massage device in accordance with the present invention.
Figure 2:
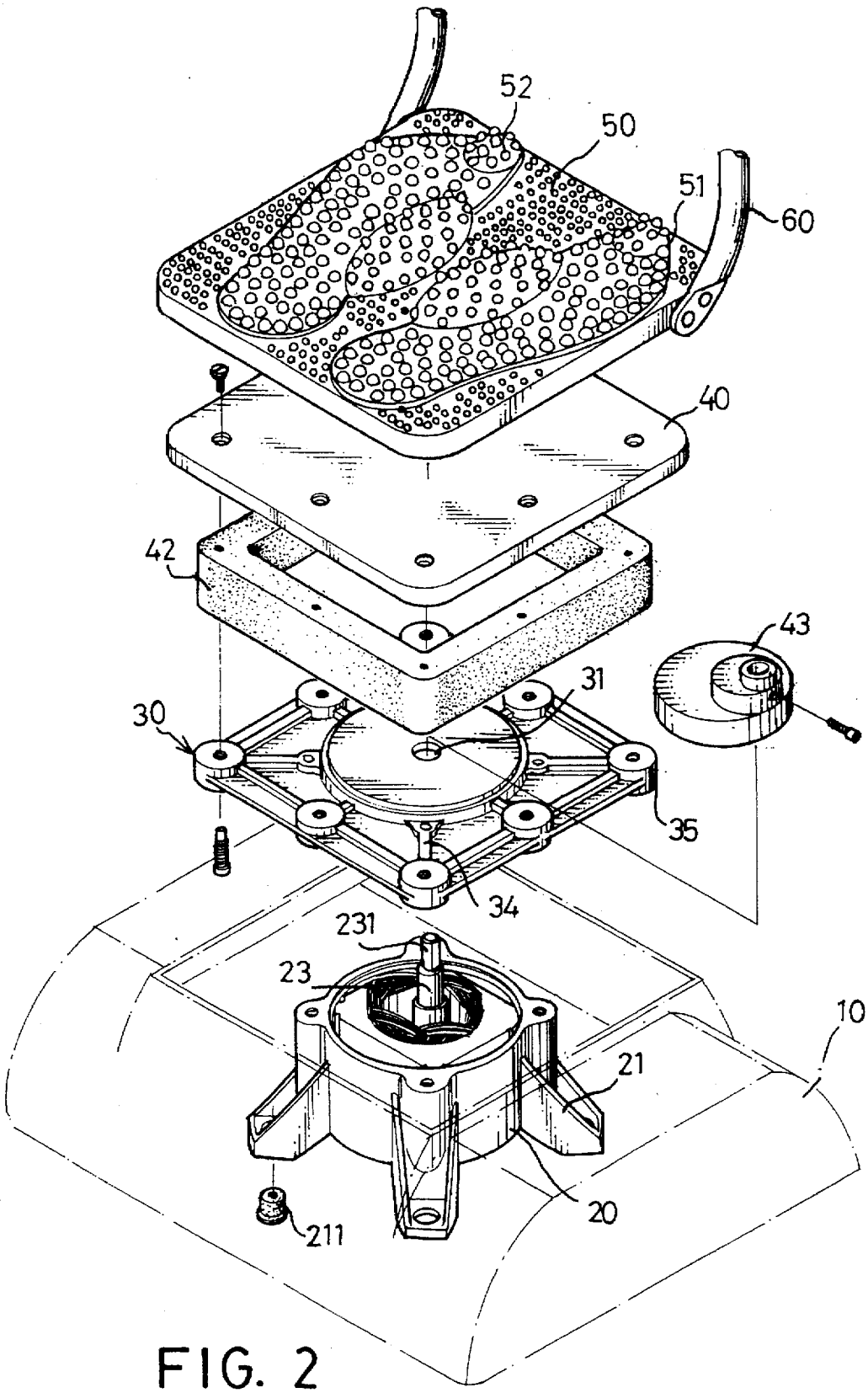
FIG. 2 is an exploded view of a base including a motor case, a motor received in the motor case, a cap and a massage pad in accordance with the present invention.
Figure 3:
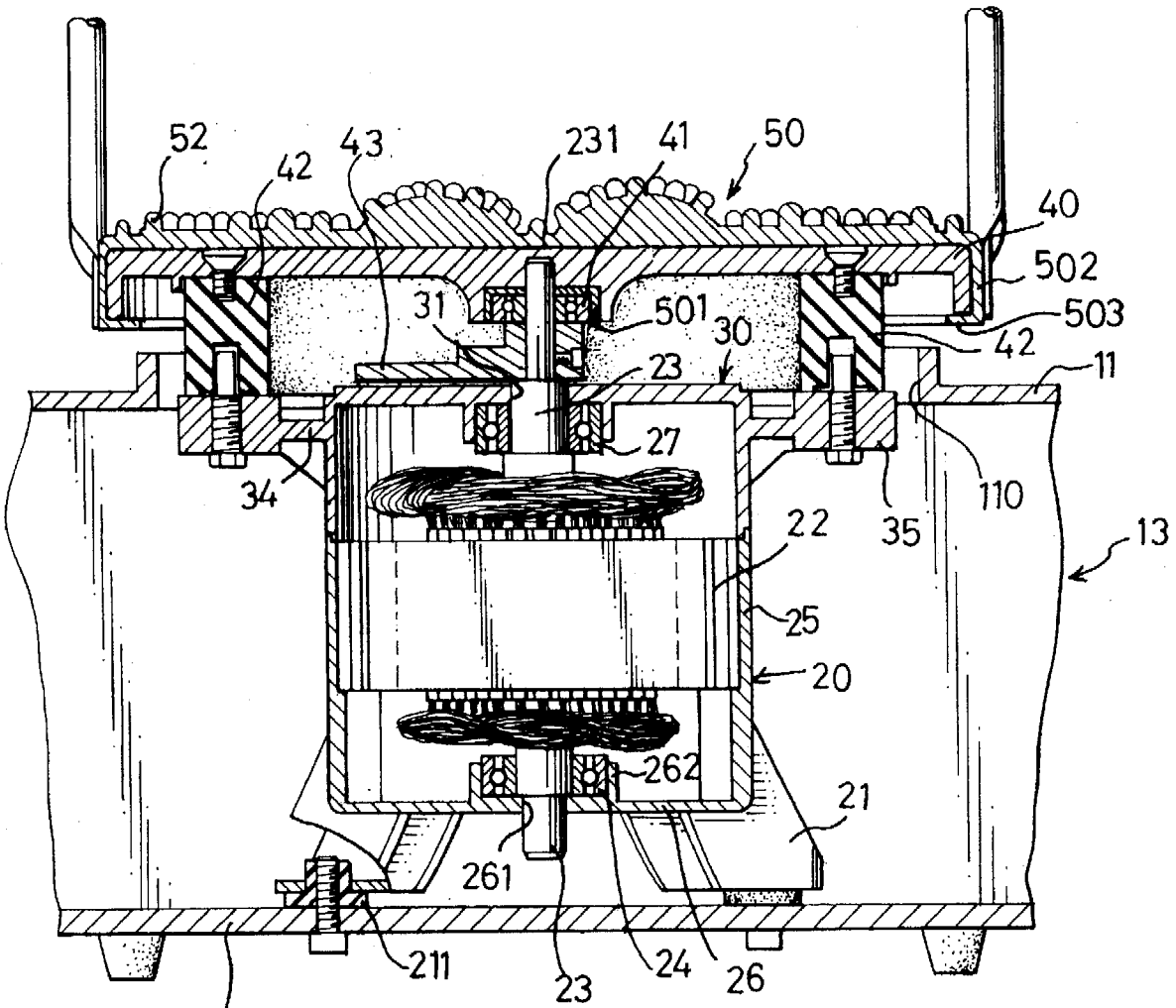
FIG. 3 is a side elevational view, partly in section, of the base shown in FIG. 2 in accordance with the present invention.

Referring to the drawings and initially to FIGS. 1 through 3, a massage device in accordance with the present invention generally includes a base 10 having a top plate 11, a first bottom plate 12 and a first peripheral wall 13 connected between the top plate 11 and the first bottom plate 12 wherein the top plate 11 has a first hole 110 defined therein.

A motor case 20 has a second bottom plate 26 and a second peripheral wall 25 extending from a periphery of the second bottom plate 26. The second bottom plate 26 has a second hole 261 defined therein and a first receiving portion 262 formed on a top surface thereof so as to receive a first bearing 24 in the first receiving portion 262. At least three feet 21 extend downwardly from the motor case 20 and an absorbing member 211 is disposed between each of the feet 21 of the motor case 20 and the first bottom plate 12 of the base 10.

A motor 22 is fixedly disposed in the motor case 20 and has a shaft 23 having one end thereof rotatably extending through the first bearing 24 and the second hole 261.

A cap 30 is mounted to the second peripheral wall 25 of the motor case 20 by threading bolts not shown through the cap 30 and an upper edge of the motor case 20 The cap 30 further has a third hole 31 defined therein such that the other end of the shaft 23 rotatably extends through the third hole 31 via a second bearing 27. At least three ribs 34 are formed on the cap 30 and each of the ribs 34 has a block 35 formed thereto. An eccentric rod 231 extends from the other end of the shaft 23 extending through the third hole 31 and a weight 43 having a hole defined eccentrically therein so as to be mounted to the eccentric rod 231.

Figure 4:
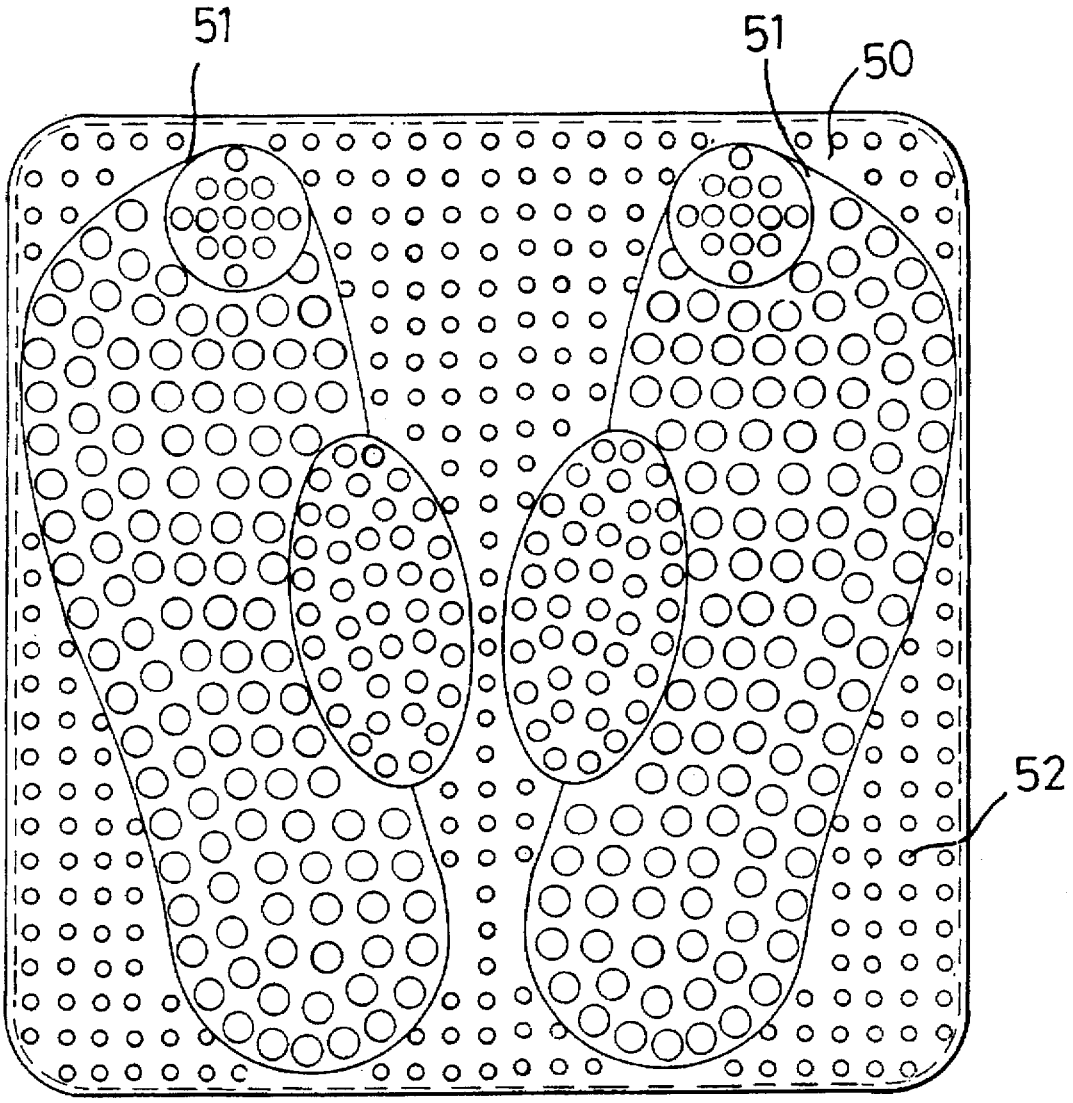
FIG. 4 is an illustrative view to show a pattern of the top surface of the massage pad in accordance with the present invention.

A massage pad 50 has a plurality of first massage protrusions 52 extending from an upper surface thereof and a recess 501 defined in an under surface thereof such that the eccentric rod 231 cooperated with a third bearing 41 are rotatably received in the recess 501. The massage pad 50 has a skirt portion 502 extending downwardly therefrom and a flange 503 extends inwardly from a lower edge of the skirt portion 502 so as to receive a middle plate 40 in the skirt portion 502 wherein the middle plate 40 contacts the under surface of the massage pad 50. The massage pad 50 together with the middle plate 40 are fixedly connected to the blocks 35 with a cushion means 42 disposed between the middle plate 40 and the blocks 35 wherein the cushion means 42 is fixedly disposed between the middle plate 40 and the cap 30 by extending bolts through the middle plate 40 the cushion means 42 and the blocks 35. Further referring to FIG. 4, the massage pad 50 has two foot portions 51 formed on the top surface thereof and each of the foot portions 51 has an outer configuration which complementally matches a bottom of a user's foot sole.(see FIG. 5).

Figure 5:
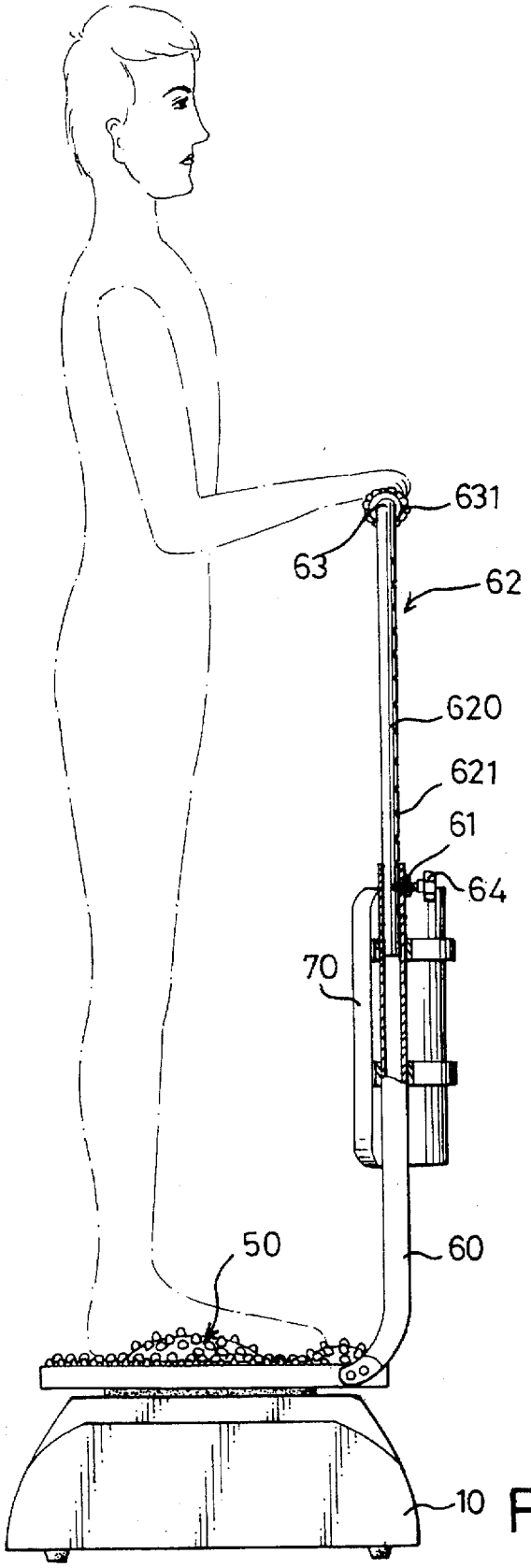
FIG. 5 is an illustrative view to show a user stand on the massage pad of the massage device with a frame extended from two tubes of the base in accordance with the present invention.
Figure 6:
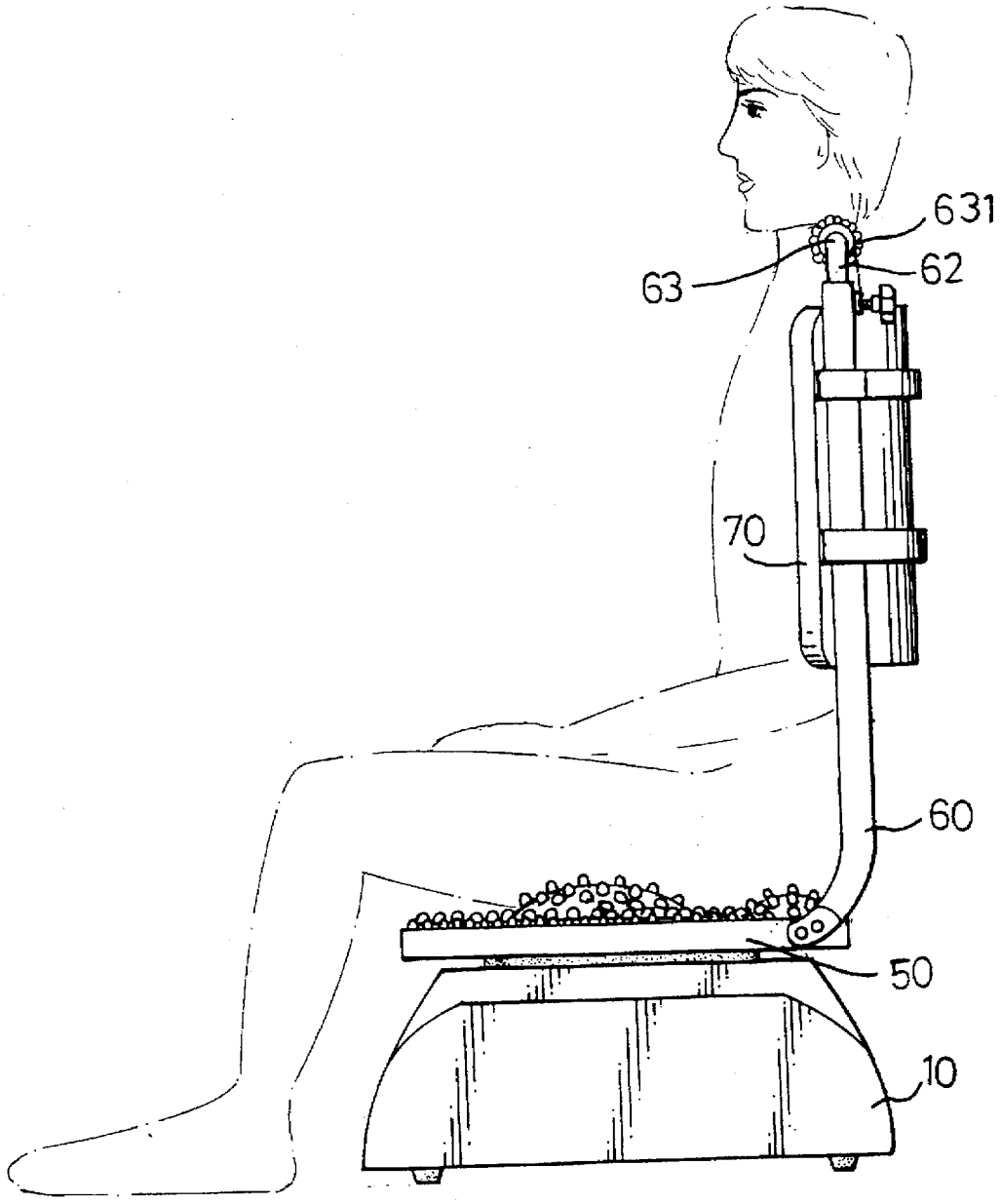
FIG. 6 is an illustrative view to show another user sit on the massage pad with the frame retracted in the two tubes.

Referring to FIGS. 1, 5 and 6, two tubes 60 extend respectively from two opposite sides of the massage pad 50 and each of the tubes 60 has an open top defined therein and a fourth hole 61 defined laterally therein. A frame 62 has a transverse handle 63 and two extending tubes 620 respectively extend from both of two ends of the transverse handle 63 so as to be retractably received in the tubes 60 extending from the massage pad 50. A grip 631 is mounted to the transverse handle 63 and a plurality of third massage protrusions 632 extend from the grip 631. At least one of the two extending tubes 620 has a plurality of dimples 621 defined therein such that the two extending tubes 620 are adjustably positioned by extending an adjusting bolt 64 through the fourth hole 61 and being inserted in one of the dimples 621. A back rest 70 is mounted to the two tubes 60 and a plurality of second massage protrusions 71 (FIG. 1) extend from the back rest 70.

Accordingly, the user can stand on the massage pad 50 with the frame 62 being pulled upwardly so as to hold the grip 631 with by hand and when the motor 22 is actuated, the eccentric rod 231 is rotated to let the massage pad 50 be reciprocally moved to stimulate bottoms of the user's feet as shown in FIG. 5. In FIG. 6, another user retracts the frame 62 in the tubes 60 and sits on the massage pad 50 with her back contacting the rest back 70 and her neck resting on the grasp 631. The cushion means 42 absorbs shocks when the motor 22 is actuated so as to provide the user a comfortable operation condition. The motor case 20 is easily to be disposed on the bottom plate 12 by extending bolts from outside of the bottom plate 12 to position the feet 21 of the motor case.20.

Although the invention has been explained in relation to its preferred embodiment, it is to be understood that many other possible modifications and variations can be made without departing from the spirit and scope of the invention as hereinafter claimed.

What is claimed is:

1. A massage device comprising:

a base having a top plate, a first bottom plate and a first peripheral wall connected between said top plate and said first bottom plate, said top plate having a first hole defined therein;

a motor case having a second bottom plate and a second peripheral wall extending from a periphery of said second bottom plate, said second bottom plate having a second hole defined therein, at least three feet extending downwardly from said motor case;

a motor being fixedly disposed in said motor case and having a shaft with one end thereof extending through said second hole, said shaft having an eccentric rod extending from the other end thereof, a weight having a hole eccentrically defined therein so as to be mounted to said eccentric rod;

a cap mounted to said second peripheral wall of said motor case and having a third hole defined therein such that said eccentric rod of said shaft extends through said third hole, at least three ribs extending laterally from said cap and each of said ribs having a block formed thereto, and a massage pad having a plurality of first massage protrusions extending from an upper surface thereof and a recess defined in an under surface thereof such that said eccentric rod is rotatably received in said recess, said massage pad fixedly connected to said blocks with a cushion means disposed between said massage pad and said blocks.

2. The massage device as claimed in claim 1 wherein an absorbing member is disposed between each of said feet of said motor case and said first bottom plate of said base.

3. The massage device as claimed in claim 1 wherein said massage pad has a skirt portion extending downwardly therefrom and said skirt portion has a flange extending inwardly from a lower edge thereof so as to receive a middle plate in said skirt portion wherein said middle plate contacts said under surface of said massage pad, said cushion means being positioned by respectively extending bolts through said middle plate, cushion means and said blocks.

4. The massage device as claimed in claim 1 wherein two tubes extend respectively from two opposite sides of said massage pad and each of said tubes has an open top defined therein, a fourth hole defined laterally in each of said tubes, a frame having a transverse handle with two extending tubes respectively extending from both of two ends of said transverse handle and at least one of said two extending tubes having a plurality of dimples defined therein such that said two extending tubes are retractably received in said tubes extending from said massage pad and are positioned by extending an adjusting bolt through said fourth hole and being inserted in one of said dimples.

5. The massage device as claimed in claim 4 wherein a back rest is mounted to said two tubes.

6. The massage device as claimed in claim 5 wherein a plurality of second massage protrusions extend from said back rest.

7. The massage device as claimed in claim 4 wherein a grip is mounted to said transverse handle.

8. The massage device as claimed in claim 7 wherein a plurality of third massage protrusions extend from said grip.

* * * * *